United States Patent [19]

Bergervoet et al.

[11] Patent Number: 4,977,354

[45] Date of Patent: Dec. 11, 1990

[54] ELECTRODELESS LOW-PRESSURE DISCHARGE LAMP

[75] Inventors: Jozef R. M. Bergervoet; Leonardus U. E. Konings, both of Eindhoven, Netherlands

[73] Assignee: U.S. Philips Corporation, New York, N.Y.

[21] Appl. No.: 317,374

[22] Filed: Mar. 1, 1989

[30] Foreign Application Priority Data

Mar. 9, 1988 [NL] Netherlands ..... 8800584

[51] Int. Cl.[5] ..... H05B 41/24; H05B 41/02

[52] U.S. Cl. ..... 315/248; 313/153; 313/161

[58] Field of Search ..... 315/248; 313/153, 155, 313/160, 161

[56] References Cited

U.S. PATENT DOCUMENTS 4,048,541 9/1977 Adams et al. ..... 315/248

4,253,047 2/1981 Walker et al. ..... 315/248

4,710,678 12/1987 Houkes et al. ..... 315/39

*Primary Examiner*—David Mis

*Attorney, Agent, or Firm*—Brian J. Wieghaus

[57] ABSTRACT

Electrodeless low-pressure discharge lamp having a glass lamp vessel (1) which is sealed in a gaas-tight manner and which is filled with at least a metal vapor and a rare gas, said lamp having a first winding (6) which is connected to a high-frequency electric power supply unit and which generates an electric discharge in the lamp vessel (1), one of the supply wires of the first winding being electrically connected to a supply wire of a second winding (12) which extends at the area of the first winding and which has a free end (13), whilst the potential gradient between the ends of the first winding (6) is substantially equal to that of the second winding (12) during operation, ignition antennas (14, 15) being secured to the free end (13) of the second winding (12) and to one end (16) of the first winding (6).

5 Claims, 1 Drawing Sheet

ELECTRODELESS LOW-PRESSURE DISCHARGE LAMP

BACKGROUND OF THE INVENTION

The invention relates to an electrodeless low-pressure discharge lamp having a glass lamp vessel which is sealed in a gas-tight manner and which is filled with at least a metal vapour and a rare gas, said lamp having a first winding which is connected to a high-frequency electric power supply unit and which generates an electric discharge in the lamp vessel, one of the supply wires of the first winding being electrically connected to a supply wire of a second winding which extends at the area of the first winding and which has a free end, the potential gradient between the ends of the first winding being substantially equal to that of the second winding during operation Such a lamp is known from Netherlands Patent Application No. 8401307 laid open to public inspection.

This lamp, formed as a high-frequency operated fluorescent electrodeless low-pressure mercury vapour discharge lamp having a bulb-shaped lamp vessel, is used, inter alia as an alternative for an incandescent lamp for general illumination purposes.

In the above-mentioned lamp, the ends of the first winding (surrounding a rod-shaped ferrite core) are connected to a high-frequency oscillator power supply circuit, for example of a type as described in Netherlands Patent Application No. 8004175 laid open to public inspection. Such a circuit is comparatively simPle and during operation of the lamp one of the supply wires of the winding is permanently at a zero potential level. Due to the presence of a second winding, high-frequency electric interference currents occurring during lamp operation in the conductors of the power supply mains are reduced to an acceptable level. The number of turns of the two windings is preferably equal in order to obtain the same potential gradient (this is the potential decrease per unit length of the winding measured in the direction of its longitudinal axis). The presence of the second winding compensates for the electric interference currents, generated by the first winding, on the power supply mains.

The advantage of this known lamp is that it obviates the use of a transParent conducting layer on the inner wall of the lamp vessel, which layer is connected to one of the supply wires of the power supply mains for suppressing the said interference currents. Providing the layer and connecting the said mains conductor is complicated, timeconsuming and costly.

However, it has been found that the presence of the second winding adversely affects the ignition properties of the lamp. This can be ascribed to the fact that the lines of force of the generated electric field in the lamp vessel are contracted proximate the position where the windings are located As a result the ionization of the gas proceeds with greater difficulty. This is notably the case in lamps in which the power consumption is reduced (dimmed state).

SUMMARY OF THE INVENTION

It is an object of the invention to provide an electrodeless low-pressure gas discharge lamp of the type described in the opening paragraph whose ignition ProPerties are improved and in which the interference currents, generated by the lamp, on the power supply mains are as small as possible.

According to the invention such a lamp is therefore characterized in that ignition antennas are secured to the free end of the second winding and to one end of the first winding.

A lamp according to the invention has a low ignition voltage as compared with the said known lamp. It has been found in a practical embodiment that the ignition voltage is a factor of 2 to 3 lower. The electric yield generated by the antennas hardly contributes to interference currents on the power supply mains.

The two antennas are coupled to the windings in such a way that during lamp operation a relatively large potential difference is present between the antennas. The antenna which is secured to the free end of the second winding has a potential which is in phase opposition with the signal from the high-frequency power supply source. The other antenna (which is secured to the first winding) is in phase with this power supply source One of the supply wires of the first winding is substantially constantly at a zero potential.

It is to be noted that U.S. Pat. No. 4,253,047 describes an electrodeless low-pressure discharge lamp in which an annular core of magnetic material is present in the lamp vessel. The annular core has a single winding whose ends are connected to a high-frequency oscillator circuit At the area of the symmetry axis of the annular core the lamp vessel comprises two ignition electrodes located on either side of this core, which electrodes are connected to the winding. These electrodes are provided with emissive material. The drawback of such a construction is that a comparatively large voltage difference is generated between the electrodes which are located at a short distance from each other, with the result that emissive material easily enters the lamp vessel This will readily lead to blacking of the wall. Moreover, additional means are required to stabilize the discharge between the starter electrodes It is neither evident from the Patent in how far the interference requirements are satisfied.

The windings and the antennas in the lamp according to the invention are located, for example, without a core in the gaseous atmosphere of the lamp vessel, or they surround a rod-shaped core of synthetic material or ceramic material. In a preferred embodiment of the lamp according to the invention a rod-shaped core of a magnetic material is Present and it is surrounded by the two windings which are present in a tubular indentation in the wall of the lamp vessel. Such a preferred embodiment of the lamp is characterized in that the antennas are also present in the said indentation and extend on either side of the rod-shaped core parallel to the longitudinal axis of said core. The antennas are, for example wire-shaped or strip-shaped extending parallel to the wall of the tubular indentation.

The advantage of this embodiment is that special leadthrough constructions in the wall of the lamp vessel for the antennas are avoided. Such a lamp can be manufactured in a simple manner, ensuring ready ignition when starting the lamp (also in a situation with a low power consumption, i e in the case of a dimmed state).

In a special embodiment, the lamp vessel is sealed in a gas-tight manner by means of a glass sealing member provided with a tubular indentation for a rod-shaped core (which indentation is located in the longitudinal direction of the lamp in a practical embodiment) and a conical wall portion This lamp is characterized in that the antennas extend at least on the outer wall of the conical wall portion and are located substantially opposite to each other.

This embodiment is notably advantageous if there is little space to accommodate the said antennas between the rod-shaped core with the two windings and the juxtaposed wall of the tubular indentation. Therefore, the advantage of this embodiment is that its manufacture may be less complicated.

BRIEF DESCRIPTION OF THE DRAWINGS

The invention will now be described in greater detail, by way of example, with reference to the accompanying drawing in which.

DESCRIPTION OF THE PREFERRED EMBODIMENTS

Figure 1:
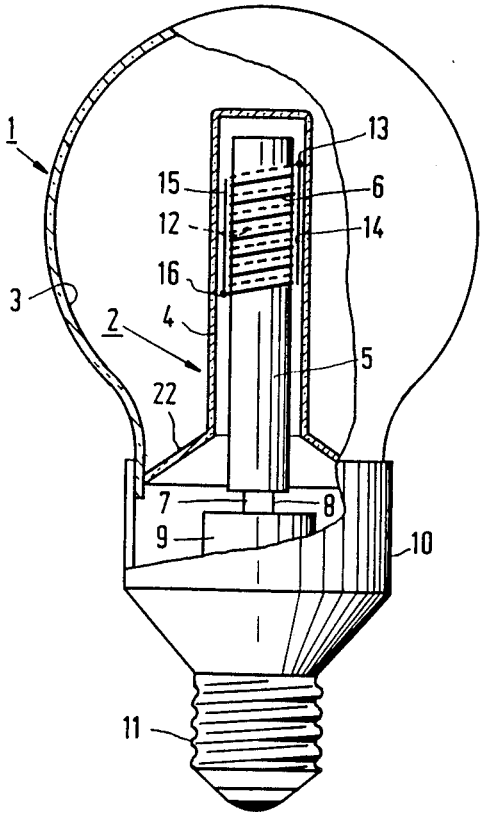
FIG. 1 shows partly in an elevational view and partly in a cross-section a first embodiment of an electrodeless low-pressure mercury vapour discharge lamp according to the invention.

The lamp of FIG. 1 has a glass bulb-shaped lamp vessel 1 which is sealed in a gas-tight manner by means of a glass sealing member 2. This seal is realized by means of a sealed connection between the conical wall portion 22 of member 2 and the lamp vessel 1. The lamp vessel is filled with mercury and a rare gas such as argon. A luminescent layer 3 is present on the inner wall of the lamp vessel. The sealing member 2 has a tubular indentation 4 accommodating a rod-shaped core 5 of ferrite A first winding 6 surrounds this core and its ends 7 and 8 are connected to a high-frequency oscillator power supply 9 shown diagrammatically (as described in said Netherlands Patent Application 8004175 laid open to public inspection) which is present in a thin-walled synthetic material housing 10 connected at one end to the lamp vessel 1 and at the other end having the lamp cap 11 with which the lamp can be screwed into a holder for incandescent lamps.

During operation of the lamp an electric discharge is generated in the lamp vessel by means of winding 6 and the power supply 9. At one point the winding 6 is electrically connected to a second winding 12 (shown in a broken line) which has a free end 13 (see also FIG. 2). This second winding 12 has substantially the same number of turns as the first winding 6 and is wound in the same way. The two windings are electricallY insulated from each other. The potential gradient between the ends of winding 6 is substantiallY equal to the potential gradient between the ends of winding 12.

According to the invention a wire-shaped antenna 14 is secured to the free end 13 of the second winding 12; this antenna is electrically insulated from the two windings 6 and 12 and it is stretched and extends substantially throughout the length of the two windings, whilst antenna 15 is secured to the end remote from 13. This antenna is also wire-shaped, stretched and electricallY insulated from the two windings. The antennas 14 and 15 are located on either side of the rod 5. The length corresponds to that of antenna 14. The antenna 15 is secured proximate the first turn of winding 6. This position is denoted by 16 in the Figure. The antennas are present in the space between the windings and the wall of the tubular indentation 4.

A potential difference having such a value that the lamp readily ignites and re-ignites is present between the antennas 14 and 15. In fact, the two antennas constitute the poles of a high-frequency electric field. The operation of the antennas will be further described with reference to FIG. 2.

Figure 2:
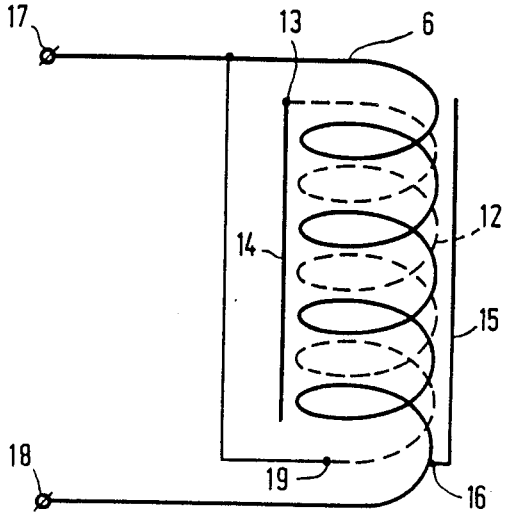
FIG. 2 shows diagrammatically the position of the antennas and the windings in the lamp of FIG. 1.

FIG. 2 shows diagrammatically the position in circuit of the two windings with the antennas coupled thereto in the lamp of FIG. 1. The output terminals of the high-frequency power supply oscillator are denoted by 17 and 18. The other reference numerals are the same as those in FIG. 1.

A high-frequency power supply unit (not further shown) is connected between the terminals 17 and 18. Terminal 17 is continuously at substantially zero potential Whilst the high-frequency oscillator voltage is applied to terminal 18 This is a so-called asymmetrical source. If the potential at terminal 18 is positive and is zero at terminal 17, the potential at position 16 is also positive as well as at the antenna 15. At the position 19 the potential is the same as at terminal 17 (zero in this example). The potential at the free end 13 is negative and therefore it is also negative at the antenna 14 which is secured to the free end. The maximum potential difference is then present between the two antennas 14 and 15 so that an ionization takes place in the gaseous atmosphere of the lamp vessel 1, which leads to a ready ignition of the lamp. Due to the double windings the interference currents on the power supply mains are reduced to a minimum. Also the potentials of the antennas 14 and 15 are substantially equally large but opposed to each other so that the interference currents on the power supply mains are as small as possible.

Figure 3:
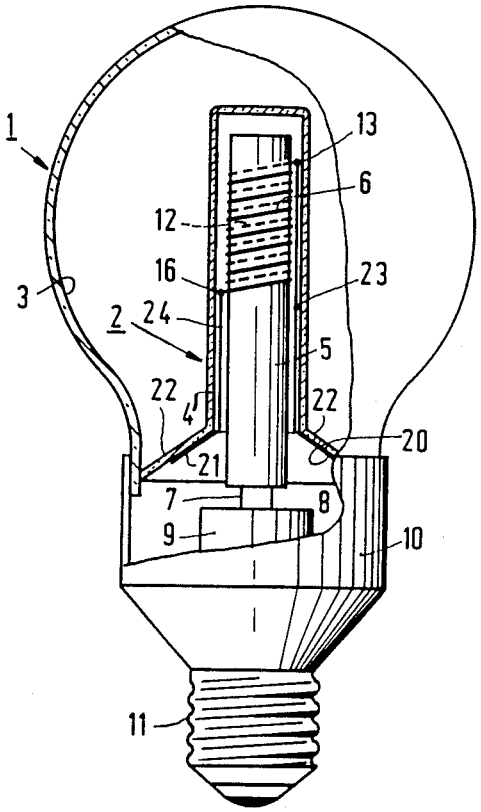
FIG. 3 shows also partly in an elevational view and partly in a cross-section a second embodiment of an electrodeless lowpressure mercury vapour discharge lamp according to the invention.

In the embodiment of the lamp of FIG. 3 the same components of the lamp have the same reference numerals as those in the lamp of FIG. 1. However, in this embodiment of the lamp according to the invention the antennas are not only located next to the windIngs 6 and 12 but they are partlY formed as strips 20 and 21 of a conducting material such as aluminum which are secured against the conically extending wall portion 22 of sealing member 2 (for example by means of cement. The said strips (for example a foil) are located substantially opposite to each other and are connected via wires 23 and 24 to position 16 (end of winding 6) and 13 (free end of winding 12), respectively. The lamp also ignites readily with these antennas 20 and 21.

Several experiments were carried out with the lamp described with reference to FIG. 1. The lamp vessel 1 accommodated a cylindrical ferrite core 5 having a length of approximately 55 mm, diameter 12 mm, surrounded by a first winding having thirteen turns of copper wire (thickness 0.2 mm). The length of the winding measured along the longitudinal axis was 25 mm. The second winding, which was likewise of copper wire of the same thickness, had thirteen turns (length 28 mm). The antennas 14 and 15 were copper wires with a length of approximately 26 mm. During operation such a lamp had an efficiency (inclusive of the circuit) of approximately 60 lm/W and the inner wall was coated with a luminescent layer of a mixture of green-luminescing terbium-activated cerium magnesium aluminate and red-luminescing trivalent europium-activated yttrium oxide. The lamp vessel contained mercury and argon (pressure 33 Pa).

Many variations within the scope of the invention are possible to those skilled in the art. For example, plate-shaped instead of wire-shaped antennas can be used, which may even be accommodated within the lamp vessel. Moreover, two windings may be used, with the first winding being wound clockwise and the second being wound counterclockwise. One antenna is then secured to the free end of the second winding wound counter-clockwise and the other is secured to the end of the first winding This end is located proximate to the position where the other antenna is secured. As it were, the two windings are then cross-wound.

What is claimed is:

1. An electrodeless low-pressure discharge lamp comprising a translucent lamp vessel sealed in a gas-tight manner and filled with a metal vapor and a rare gas, said lamp having a first winding for generating an electrical discharge in the lamp vessel during lamp operation, said first winding having respective ends and supply wires extending from each end for connection to a high-frequency electric power supply unit, and a second winding which extends at the area of the first winding and has a supply wire and a free end, one of the supply wires of the first winding being electrically connected to said supply wire of said second winding, the potential gradient between the ends of the first winding being substantially equal to that of the second winding during operation, characterized in that ignition antennas are secured to the free end of the second winding and to one end of the first winding.

2. An electrodeless low-pressure discharge lamp as claimed in claim 1, further comprising said lamp vessel having a tubular indentation, an elongate rod-shaped core of a magnetic material surrounded by said two windings and disposed in said tubular indentation, said antennas being present in the said indentation and extending on either side of the rod-shaped core parallel to the core.

3. An electrodeless low-pressure discharge lamp as claimed in claim 2, in which the lamp vessel is sealed in a gas-tight manner by means of a glass sealing member comprising said tubular indentation for said rod-shaped core and a conical wall portion, said antennas extending at least on the outer wall of the conical wall portion.

4. An electrodeless low-pressure discharge lamp as claimed in claim 3, characterized in that the antennas are in the form of aluminum strips which are adhered to the wall and are located substantially opposite to each other.

5. An electrodeless low-pressure discharge lamp as claimed in claim 2, characterized in that the antennas are in the form of aluminum strips which are adhered to the wall and are located substantially opposite to each other.

* * * * *